US010959890B2

(12) United States Patent
Campbell et al.

(10) Patent No.: US 10,959,890 B2
(45) Date of Patent: Mar. 30, 2021

(54) SAFETY MOVEMENT, REPOSITIONING AND TRANSPORT DEVICE

(71) Applicants: Jess Lybbert Campbell, Saratoga Springs, UT (US); Carlos Antonio Gresati Hallit, Jalisco (MX); Frederick James Black, Washington, UT (US)

(72) Inventors: Jess Lybbert Campbell, Saratoga Springs, UT (US); Carlos Antonio Gresati Hallit, Jalisco (MX); Frederick James Black, Washington, UT (US)

(73) Assignee: SecurLyft, American Fork, UT (US)

( * ) Notice: Subject to any disclaimer, the term of this patent is extended or adjusted under 35 U.S.C. 154(b) by 0 days.

(21) Appl. No.: 16/273,998

(22) Filed: Feb. 12, 2019

(65) Prior Publication Data

US 2019/0247247 A1 Aug. 15, 2019

Related U.S. Application Data

(60) Provisional application No. 62/629,542, filed on Feb. 12, 2018.

(51) Int. Cl.
*A61G 1/01* (2006.01)
*A61G 1/048* (2006.01)

(52) U.S. Cl.
CPC ..... *A61G 1/01* (2013.01); *A61G 1/048* (2013.01)

(58) Field of Classification Search
CPC ..... A61G 1/01; A61G 1/048; A61G 1/013
See application file for complete search history.

(56) References Cited

U.S. PATENT DOCUMENTS

| | | | | | |
|---|---|---|---|---|---|
| 5,386,604 | A * | 2/1995 | Ricketts | A61G 1/01 | 5/413 R |
| 5,442,821 | A * | 8/1995 | Weeks | A61G 1/01 | 5/627 |
| 5,978,989 | A * | 11/1999 | Chavez | A61G 1/01 | 294/140 |
| 2010/0203780 | A1* | 8/2010 | Hobbs | A61G 1/013 | 441/80 |
| 2011/0265263 | A1* | 11/2011 | Bartholomew | A61G 1/01 | 5/627 |
| 2014/0174378 | A1* | 6/2014 | Bartholomew | A61G 1/01 | 119/843 |
| 2015/0143634 | A1* | 5/2015 | Beaulieu | A61G 1/01 | 5/626 |
| 2016/0242974 | A1* | 8/2016 | Rugfelt | A61G 1/01 | |
| 2018/0271723 | A1* | 9/2018 | Adkins | A61G 1/01 | |
| 2019/0133850 | A1* | 5/2019 | Offen | A61G 1/01 | |

* cited by examiner

*Primary Examiner* — Eric J Kurilla
(74) *Attorney, Agent, or Firm* — Magleby, Cataxinos & Greenwood, P.C.

(57) ABSTRACT

A patient movement, repositioning and transport device, including a substantially rectangular sheet, a continuous pattern of woven reinforcing members within the rectangular sheet, and a plurality of handles.

3 Claims, 3 Drawing Sheets

SAFETY MOVEMENT, REPOSITIONING AND TRANSPORT DEVICE

CROSS-REFERENCE TO RELATED APPLICATIONS

This application claims the benefit of U.S. Provisional Application No. 62/629,542 filed on Feb. 12, 2018, the entirety of which is incorporated herein.

TECHNICAL FIELD

This disclosure relates generally to medical equipment, and more particularly to bed linen suitable for pre-hospital emergency and hospital patient movement, repositioning, transfer, and transport.

BACKGROUND OF INVENTION

In emergency situations, first responders and caregivers frequently move, reposition and transfer patients from accident sites to ambulance gurneys and from gurneys to treatment beds in emergency rooms. The nature of moving an incapacitated patient, of course, introduces a number of potential issues. Patient safety necessitates requires support of substantial weight and awkward limbs during transfer to avoid dropping or harming the patient. Movement and lifting devices also contain and absorb potentially harmful bodily fluids. While patient safety is paramount, other considerations for design of transfer devices pertain to first responders and caregivers. For example, repetitive moving and repositioning in dangerous and precarious environments causing injuries may result in increased downtime and workers compensation claims.

Many of the devices currently used for patient movement suffer from similar deficiencies. There are a number of devices for patient lifting that require combination of a sling and mechanical movement, repositioning using a mechanical apparatus. Any such sling must first be manipulated under the patient, causing potential discomfort. The patient is then moved and repositioned. In some examples, boards may be inserted under the patient. Both types of techniques involve extra patient movement and a secondary apparatus and places the patient at an increased level to exacerbate injuries. Such techniques are neither simple nor compatible with ambulance and gurney operations. While simple patient slings are known, very few have strength appropriate to accommodate the full range of patients.

Accordingly, there remains a need for a strong and ergonomic patient movement, repositioning and transport device also designed to reduce injuries, and increase safety to first responders and caregivers.

SUMMARY OF THE INVENTION

According to an embodiment of the present disclosure, a patient movement, repositioning and transport device is provided that comprises a substantially rectangular sheet. Within the rectangular sheet, a continuous pattern of woven reinforcing members and webbing are provided. The patient movement, repositioning and transport device according to the embodiment also comprises a plurality of handles.

In another embodiment according to the disclosure, pockets and/or openings to facilitate bed to bed transfer of patients are provided therein.

In another embodiment of the disclosure, the substantially rectangular sheet comprises a single layer of woven material.

In another embodiment, the substantially rectangular sheet of the disclosure comprises a mixture of polyester and cotton, and may optionally include a carbon fiber. This mixture of polyester and cotton may further comprise a ripstop material. Alternatively, the sheet may comprise a material selected from the group selected from cotton, polyester, silk, nylon, and/or polypropylene.

According to another embodiment of the disclosure, the patient movement, repositioning and transport device may be constructed from material weighing from about 80-350 GSM.

Other embodiments of the disclosure may provide that the patient movement, repositioning and transfer device is laser light compatible.

According to embodiments of the disclosure, the patient movement, repositioning and transport device comprises strength characteristic providing for a weight bearing capacity greater than 1000 lb.

DETAILED DESCRIPTION

Figure 1:
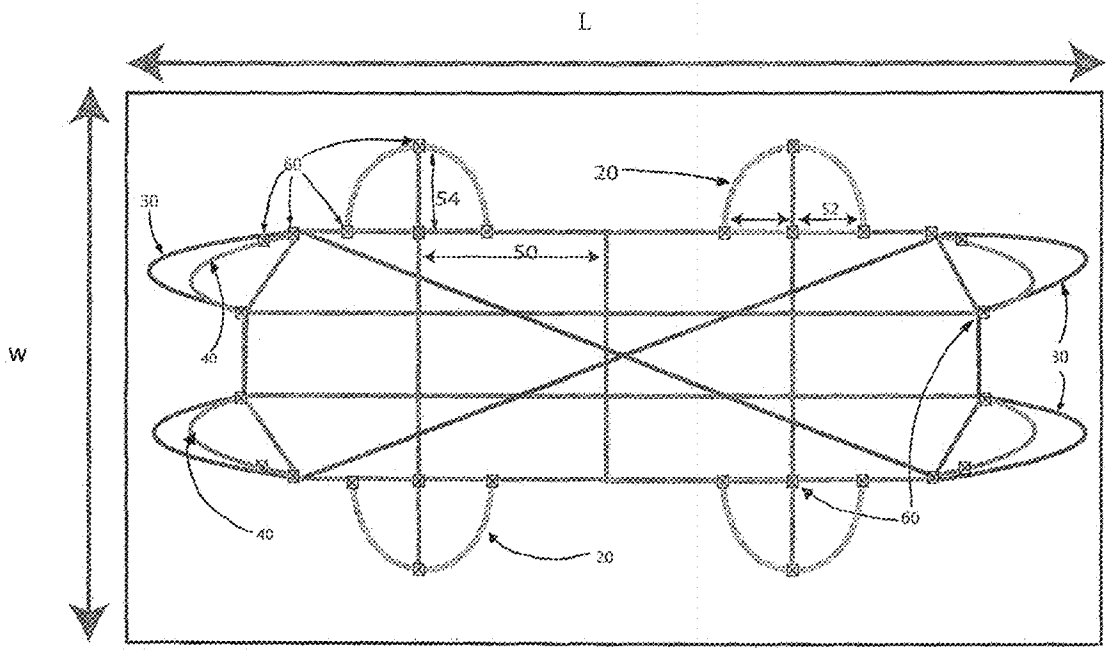
FIG. 1 is a top view of an embodiment, showing a portion of the reinforcing weave pattern of the disclosure.

The disclosure describes a device used by first responders in pre-hospital, as well as hospital, emergency care. Embodiments of the disclosure integrate first responder, health care providers, and patient safety while movement, repositioning, transporting, and transferring injured patients and non-ambulatory persons. Embodiments of the disclosure are further designed to protect care providers from movement, repositioning, and twisting back, neck, shoulder, and extremity injuries. These design elements reduce first responder and care provider agency exposure to workman's compensation claims and lost man hours. Further, embodiments of the disclosure protect patients from twisting, bending, and discomfort while providing body substance isolation from initial emergency response through final hospital transfers.

Embodiments as described herein may generally be sized to fit both standard emergency gurneys and hospital emergency room beds. As such, a range of lengths and widths may be provided, according to the needs of providers such as ambulance crews, helicopter emergency crews, military field personnel, emergency room staff, and the like. In particular embodiments of the disclosure, the length and width of the patient movement, repositioning and transport device may range from L=70-120 inches and W=40-80 inches.

Other embodiments of patient movement, repositioning and transport devices according to the disclosure may comprise a single layer woven sheet of material or may comprise a plurality of layers as necessary. The thread employed in embodiments of the disclosure may be any type of thread known in the art suitable for providing the desired strength and weight characteristics as described in embodiments of the disclosure. In particular embodiments, the primary thread woven into a substantially rectangular sheet may comprise a mixture of polyester and cotton fibers. Such mixtures may range from 40-80% polyester with the remainder as cotton.

Patient movement, repositioning and transport devices of the disclosure may, in some embodiments, be woven in such a manner with thread appropriate to provide a rip-stop textile. In another embodiment, such textile may be comprised of 65% polyester and 35% cotton thread with a weight of about 200 GSM. Such thread may be woven to provide warp and weft characteristics of 108 per inch (warp) and 58 per inch (weft). Furthermore, a pattern of continuously woven strapping as shown and described with regard to the FIGs below increases strength and handling capabilities of the patient movement, repositioning and transport devices. In other embodiments, the woven strapping patterns may provide movement, repositioning and transport capacity exceeding at least 1000 lbs. Such capacity is considerably more than any similar devices known to those of skill in the art. In order to provide such strength, the woven strapping may comprise woven taping of appropriate widths and compositions. In a particular embodiment, the tape may comprise 100% polyester thread to provide 1-inch wide tape of 25 G/M weight. As shown and described regarding the FIGs below, the woven tape may provide additional features including a plurality of handles to the patient movement, repositioning and transport device. Such plurality of handles may be ergonomically designed to facilitate patient movement and comfort, but may also increase safety of medical providers and patients alike due to appropriate sizing and strength sufficient to transport a variety of patients and medical equipment as may be required.

Further advantages of embodiments of the disclosure may be made possible by the choice of materials and constructions. As an example, the device may be disposable or provide for multiple uses. The materials may be laser light compatible, bacteria resistant, and provide for the reduction of static electricity generated by the textile.

As shown in FIG. 1, a preferred embodiment of the disclosure may comprise a rectangular outer sheet of length L and width W. As shown, the outer sheet may overlay strengthening elements shown in FIG. 1 as separate overlapping woven strapping elements. Such woven strapping may be arranged in a variety of patterns to increase strength of each embodiment as necessary. In the preferred embodiment of FIG. 1, the woven strapping comprises three woven strapping elements. The length L and width W of the fabric box of a preferred embodiment may be 108" long and 62" wide respectively. FIG. 1 further illustrates aspects of embodiments of the present disclosure. Handles for movement, repositioning and manipulating patients utilizing the device of the disclosure may be provided on the sides and ends of the device. Side handles 20 may be provided with a length 54 and width 52 as appropriate for a specific application. Similarly, small end handles 40 and large end handles 30 may be provided for ergonomics, strength and other purposes. Sections of overlapping strapping elements may be joined by any method known to those of skill in the art. The locations of each such joined sections may be referred to as rivets 60 herein, but may be of any known methods including glue, sewn reinforcement such as bar tacking, or mechanical fastening means such as grommets and rivets.

Figure 2:
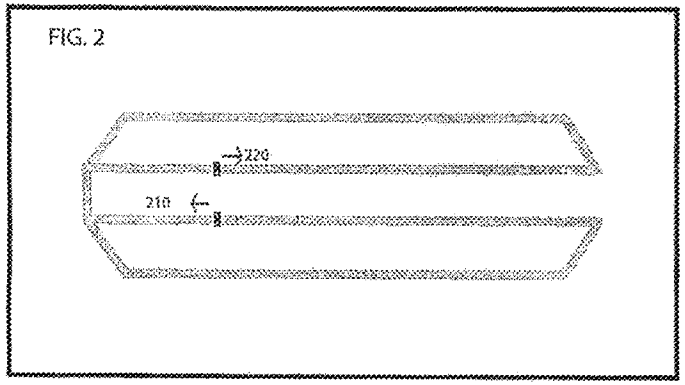
FIG. 2 is a top view of an embodiment, showing another portion of the reinforcing weave pattern of the disclosure.

FIGS. 2-7 describe one construction of a particular embodiment of the present disclosure. FIG. 2 outlines a first step toward creating one embodiment of the disclosed device, sewn reinforcement tape of the type described above, may be placed in the arrangement as shown, starting from location 210 following the direction of the arrows shown towards the left side to finish at the top part 220 at the same height.

Figure 3:
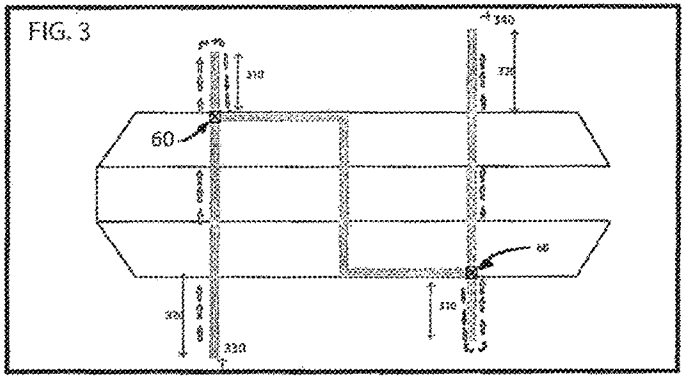
FIG. 3 is a top view of an embodiment, showing a further portion of the reinforcing weave pattern of the disclosure including end handles.

FIG. 3 outlines a second reinforcement step in an embodiment according to the disclosure. The bold line shown represents the portion of reinforcing tape applied in the previous step. The second step may start by leaving an appropriate amount 320 free, and starting to fix the rest starting from where the tape from step 1 was previously placed to the other end leaving an appropriate amount 310 free. This may be followed by returning another amount 310 to rivet 60 and continuing to sew the strip to an end 340 as indicated in the drawing of FIG. 3. The amount of tape left free 320 and 310 may be an amount appropriate toward creating the size handles required by particular embodiment. In a preferred embodiment, the amount 320 may be 12 inches and the amount 310 may be 5 inches.

Figure 4:
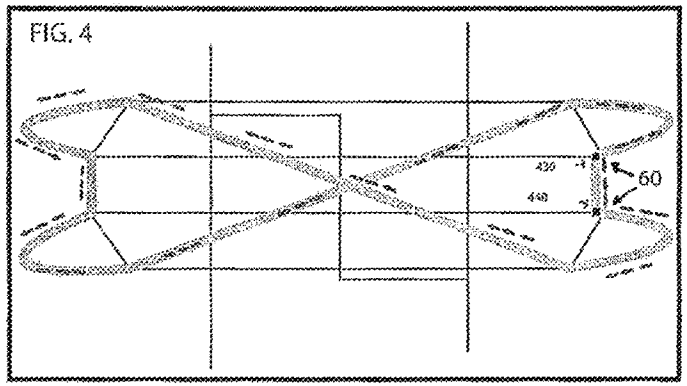
FIG. 4 is a top view of an embodiment, showing a further portion of the reinforcing weave pattern of the disclosure including reinforcement weaving of end handles.

FIG. 4 outlines a third reinforcement step in an embodiment according to the disclosure. The third step may start at a location 430 and follow the pattern of arrows shown in FIG. 4 to cross the device at a diagonal. As before, the sewn tap may be secured at rivets 60. Moreover, in the embodiment as shown, this step creates end handles 30. Upon completion of this base as shown, the end may be reinforced making the handle larger. In some embodiments, the large handles may be about 25 inches.

Figure 5:
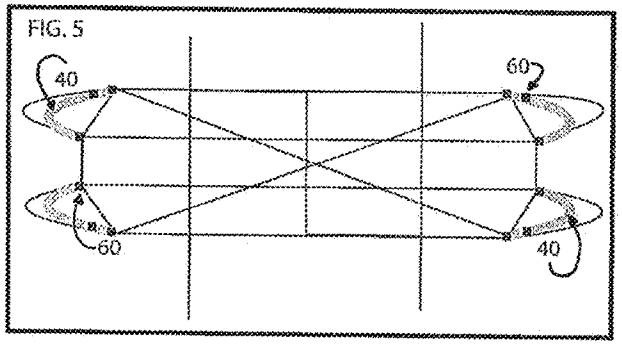
FIG. 5 is a top view of an embodiment, showing a further portion of the reinforcing weave pattern of the disclosure including side handles.

FIG. 5 outlines a fourth reinforcement step in an embodiment according to the disclosure. The fourth step may install smaller end handles 40 of an appropriate length by attaching a length of reinforcing sewn tape at the rivets 60 as shown in FIG. 5. In a preferred embodiment, the small handles 40 may be finished utilizing approximately 20-inch-long strips and leaving 1 inch per side. The small handles 40 may be fixed on the top corners with rivets 60 and consume 1 inch on each side. An extra rivet 60 may be utilized, which joins both handles 40 and 30 at a position 2 inches above the first rivet 60.

Figure 6:
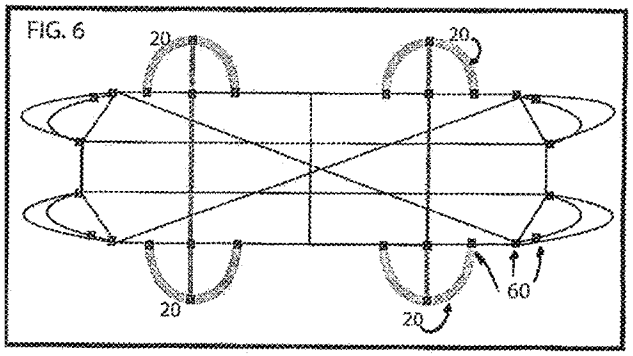
FIG. 6 is a top view of an embodiment, showing a further portion of the reinforcing weave pattern of the disclosure including reinforcing weaving of side handles.

FIG. 6 outlines a fifth reinforcement step in an embodiment according to the disclosure. Prior to starting the fifth step the strips 320 that were left in the second step without riveting must be riveted so that the side handles 20 may be attached. Thereafter, the side handles may be fixed on the sides with rivets 60 where it starts, in the middle to join them to the strips 310 that remain from the second step, and a final rivet 60 at the end. The strips of length 320 on the corner where step 2 begins and ends, shown as bold lines in FIG. 6, may be folded so that they are of length 310 finished, leaving about 1 inch extra tape for sewing that enters and 1 inch for the rivet 60.

Figure 7:
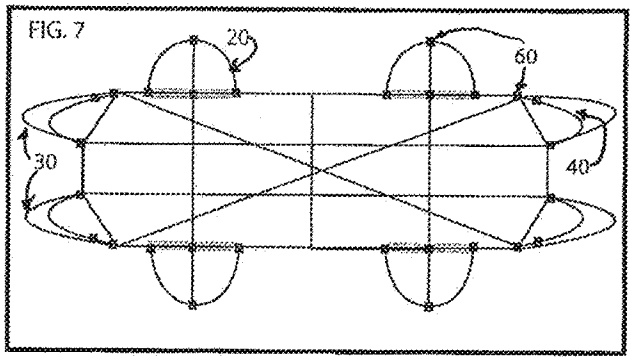
FIG. 7 is a top view of an embodiment, showing a further portion of the reinforcing weave pattern of the disclosure.

FIG. 7 outlines a sixth reinforcement step in an embodiment according to the disclosure. In the sixth step, reinforcement of the side handles 20 may be completed. Strips of reinforcement tape may be cut to an appropriate length and affixed as shown, secured by rivets 60. In a preferred embodiment, 17-inch reinforcement strips may be used to add strength to the side handles 20 by employing 15 inches of sewn reinforcement tape finished with additional consumption of 1 inch on each side for the rivets 60. The rivets 60 may be fixed at the beginning, middle and end of the tape strip. All rivets 60 may be in the form of an "x".

EXAMPLES

Example 1

A series of tests measuring the weight for the transfer device are performed. A strength test is performed on new devices by adding weight to reach 750 lbs., maintaining that weight for approximately five minutes, and then proceeding to test the device with incremental weights up to 1000 lbs. Once 1000 lbs. are reached, that weight is maintained for another five minutes, then the weight is removed. Each of the tested devices is then washed 30 times using the standard cleaning techniques for the transfer sheets. After washing, the same weight testing protocol as used prior to washing the devices is performed, keeping the 1000 lbs. of weight on for 10 minutes or until failure at the end of the testing.

Example 2

A function test for stress on a "patient" is performed to compare on between the flat sheet currently in use now and the new handled transfer sheet, as described in Examples 4 and 5. "Patients" will be healthy volunteers.

Example 3

A function test of stress on an emergency responder or health care worker when they are using a flat sheet (i.e. rolling the flat sheet in their hands) compared to using the handled transfer sheet of the invention is performed, as described in Examples 4 and 5. The test will identify the stress put on the fingers, hands, wrists, and back of the user. Testing subjects will be healthy volunteers who have some training in manual patient transfers.

Example 4

Standard transfer test from bed to a gurney: An evaluation of data collection methods comparing a standard draw sheet with a new handled sheet with built in handles is performed. Twelve manual patient transfers are conducted with each sheet type, for a total of 24 patient transfers. All but one of the trials will have four persons (workers) performing the transfer, one at the head, one at the feet, and one on each side. Transfers will be performed pulling the patient from a table (height at 29 inches), to another table (height at 26.5 inches). Patient weight will be a wide range of weights, from ~125 lbs. to ~350 lbs. Healthy volunteers will hold weight on their chest to achieve higher weights.

All patient and worker ratings will be done using a visual analog scale (VAS) with verbal anchors at each end, as is standard practice in this industry. The participant will mark their rating on the line and the distance was measured from the end with the positive verbal anchor. This measure will then be the quantified VAS score. The lower score indicates a superior rating. For patients we will also collect qualitative and quantitative assessments of perceived comfort and safety. Worker data collected will include comfort, safety and overall ratings of each transfer sheet type, a standard flat sheet and the new handled transfer sheet. Information about which sheet type was preferred for each transfer pair will be recorded.

Ergonomic measures will be performed for two workers for each transfer (24 total ergonomic measures. Ergonomic measures include the elements of the Threshold Limit Value for Hand Activity Level (TLV for HAL), the Moore-Garg Strain Index (SI), and the Revised National Institute for Occupational Safety and Health Lifting Equation (LI).

Statistical analyses include test for normality performed for all variables and then the appropriate parametric or non-parametric test for difference performed, comparing the raw score for the handled and flat sheets. Scores will also be standardized to the handled sheet to account for intra-rater bias. The flat sheet score will be a proportional value based on that workers score for the handled sheet.

Example 5

Standard lift and transfer from ground level to gurney: Evaluation of data collection methods comparing a standard lifting method with a new handled lifting sheet with built in handles is conducted. Twelve manual lifts with each lift type, for a total of 24 patient lifts are conducted. All participants will be healthy volunteers. All trials with the new handled lift sheet will have four persons (workers) performing the lift, one at the head, one at the feet, and one on each side. Transfers will be performed lifting the patient from level ground, to a gurney (height TBD). A standard lift definition will be agreed upon and compared with a lift performed using the new handled sheet. All patient and worker ratings, ergonomic measurements, and statistical analysis will be performed as described in Example 4, above.

While the disclosure has been described in connection with what is (are) considered the exemplary embodiment(s), it is understood that this disclosure is not limited to the disclosed embodiment(s) but is intended to cover various arrangements included within the spirit and scope of the broadest interpretation so as to encompass all such modifications and equivalent arrangements.

What is claimed is:

1. A patient movement, repositioning and transport device, comprising:

a substantially rectangular sheet made from ripstop material, wherein the sheet consists of a single layer of woven material comprising one or more of the group selected from cotton, polyester, silk, nylon, and/or polypropylene;

a continuous pattern of woven reinforcing members within the rectangular sheet, wherein overlapping sections of the reinforcing members are joined by rivets; and a plurality of handles disposed under and within the perimeter of the rectangular sheet, wherein the handles are formed as part of the continuous pattern of reinforcing members, wherein the device has a weight bearing capacity greater than 1000 lbs.

2. The device of claim 1 wherein the woven material weighs from about 80-350 GSM.

3. The device of claim 1, wherein the device has a weight bearing capacity greater than 1500 lbs.

* * * * *